US006494332B1

(12) United States Patent
Haughton et al.

(10) Patent No.: US 6,494,332 B1
(45) **Date of Patent: *Dec. 17, 2002**

(54) STOPPERS FOR INDIVIDUAL BEVERAGE CONTAINERS

(75) Inventors: Keith Louis Haughton, Midland (CA); Glenn Wallace Haughton, Toronto (CA); Peter Christopher Michael Hillar, Stouffville (CA)

(73) Assignee: Hide-A-Straw Inc., Grand Cayman (KY)

( * ) Notice: Subject to any disclaimer, the term of this patent is extended or adjusted under 35 U.S.C. 154(b) by 0 days.

This patent is subject to a terminal disclaimer.

(21) Appl. No.: 09/700,587

(22) PCT Filed: May 13, 1999

(86) PCT No.: PCT/CA99/00400

§ 371 (c)(1),
(2), (4) Date: Nov. 17, 2000

(87) PCT Pub. No.: WO99/59893

PCT Pub. Date: Nov. 25, 1999

Related U.S. Application Data

(63) Continuation of application No. 09/080,224, filed on May 18, 1998, now Pat. No. 6,116,446.

(51) Int. Cl.[7] ..... A47G 19/22

(52) U.S. Cl. ..... 215/355; 215/358; 215/388; 220/705

(58) Field of Search ..... 215/329, 388, 215/309, 11.5, 355, 358, 362; 220/705, 707–710, 714, 367.1; 222/526–530, 508, 464.3; 239/33

(56) References Cited

U.S. PATENT DOCUMENTS

| | | | | |
|---|---|---|---|---|
| 1,253,579 A | | 1/1918 | Deanes | |
| 2,052,307 A | | 8/1936 | Kennedy | |
| 2,175,735 A | | 10/1939 | Banks | |
| 2,432,132 A | | 12/1947 | Allen | |
| 2,613,988 A | | 10/1952 | Jarbeau | |
| 2,748,968 A | | 6/1956 | Attler | |
| 2,799,439 A | * | 7/1957 | Pugh, Sr. | 229/103.1 |
| 2,844,267 A | | 7/1958 | Petriccione | |
| 3,134,515 A | * | 5/1964 | Callahan, Jr. | 239/327 |
| 3,225,915 A | | 12/1965 | Wise | |
| 3,240,415 A | * | 3/1966 | Pugh | 229/103.1 |
| 3,268,792 A | * | 8/1966 | Barmherzig | 220/707 |

(List continued on next page.)

FOREIGN PATENT DOCUMENTS

| | | | | |
|---|---|---|---|---|
| FR | 7112461 | | 4/1971 | |
| FR | 2132546 | | 11/1972 | |
| FR | 2649080 | * | 1/1991 | 220/705 |
| JP | 4-20302 | | 1/1992 | |

*Primary Examiner*—Nathan J. Newhouse
(74) *Attorney, Agent, or Firm*—Nancy E. Hill; Hill & Schumacher

(57) ABSTRACT

A stopper (30) for use with an individual beverage container (40) is disclosed. The stopper has a generally tubular side wall (32) with an upper edge and a lower edge. The side wall is dimensioned to fit snugly in the neck (50) of the beverage container with a pressure fit. A bottom (34) extends inwardly from the side wall. A flat upper portion is integrally attached to the bottom and is spaced upwardly from the bottom. An aperture (36) is formed in the bottom or the flat upper portion. In addition, a vent hole (38) is formed in the bottom or the flat upper portion. Preferably the flat upper portion is spaced from the side walls thereby forming a trough therebetween. Preferably the aperture is formed in the bottom and dimensioned to receive a straw (58) snugly therethrough. Preferably the flat upper portion is divided into a first and a second upper portion with a channel therebetween, with the channel being contiguous with the aperture and dimensioned to receive an upper portion of the straw when in a stowed position. In an alternate embodiment the aperture and vent hole are formed between the side wall and the neck of the bottle.

24 Claims, 13 Drawing Sheets

U.S. PATENT DOCUMENTS 3,291,331 A 12/1966 Grisham et al.
3,326,695 A 6/1967 Neuhauser
3,545,604 A 12/1970 Gunther, Jr.
3,559,868 A 2/1971 Chang
3,568,870 A 3/1971 Elston
3,656,654 A 4/1972 Brinkley, III
3,717,476 A 2/1973 Harvey
3,746,197 A 7/1973 Sather
3,780,944 A 12/1973 Zubalik
3,868,043 A 2/1975 Freemyer
3,874,554 A 4/1975 Chang
3,915,331 A 10/1975 Chenault
3,946,895 A 3/1976 Pugh
3,952,910 A 4/1976 Wheeler
4,018,355 A 4/1977 Ando
4,036,392 A 7/1977 Martin
4,043,478 A 8/1977 Duncan
4,065,018 A 12/1977 Megowen et al.
4,073,404 A 2/1978 Brondyke
4,078,692 A 3/1978 Stein
4,080,989 A 3/1978 Chapelsky et al. ..... 215/309 X
4,095,710 A 6/1978 Tomiati
4,098,422 A 7/1978 Slomski
4,109,817 A 8/1978 Payne et al.
4,184,604 A 1/1980 Amberg et al.
4,187,954 A 2/1980 Striggow
4,194,674 A 3/1980 Pearson
4,216,801 A 8/1980 Aykanian
4,226,356 A 10/1980 Lemelson
4,228,913 A 10/1980 Mack et al.
4,230,112 A 10/1980 Smith
4,231,486 A 11/1980 Bock
4,239,123 A 12/1980 Lang et al.
4,243,156 A 1/1981 Lobbestael
4,243,162 A 1/1981 Klygis
4,247,016 A 1/1981 Shaw
4,291,814 A 9/1981 Conn ..... 220/709
4,305,521 A 12/1981 Komatsuta et al.
4,345,695 A 8/1982 Galloway et al.
4,356,927 A 11/1982 Cooper et al.
4,407,425 A 10/1983 Combs
4,424,913 A 1/1984 Ko
4,437,289 A 3/1984 Bedin
4,440,327 A 4/1984 Dark
4,441,623 A 4/1984 Antoniak
4,441,624 A 4/1984 Sokolowski
4,462,503 A 7/1984 Di Raffaele et al.
4,479,343 A 10/1984 Tincati
4,488,656 A 12/1984 Fukuoka et al.
4,503,992 A 3/1985 Sitko et al.
4,504,009 A 3/1985 Boik et al.
4,537,324 A 8/1985 Wang
4,544,074 A 10/1985 Evans
4,544,077 A 10/1985 Rucker
4,561,557 A 12/1985 Park et al.
4,573,631 A 3/1986 Reeves
4,582,213 A 4/1986 Park et al.
4,582,214 A 4/1986 Dart et al.
4,583,654 A 4/1986 Pufpaff et al.
4,589,569 A 5/1986 Clements
4,629,097 A 12/1986 Moore
4,630,735 A 12/1986 Jebens
4,631,715 A 12/1986 Hoover
4,645,096 A 2/1987 Grant
4,690,294 A 9/1987 Jones
4,712,702 A 12/1987 Ayabe et al.
4,714,173 A 12/1987 Ruiz
4,718,778 A 1/1988 Ichikawa
4,728,001 A 3/1988 Serba
4,733,785 A 3/1988 Turner, Jr. et al.
4,735,329 A 4/1988 Le ..... 215/388 X
4,830,204 A 5/1989 Lin
4,903,458 A 2/1990 Hakansson
4,923,083 A 5/1990 Forbes
4,923,084 A 5/1990 Forbes
4,964,562 A * 10/1990 Gordon ..... 220/258
5,054,264 A 10/1991 Miller
5,054,631 A 10/1991 Robbins, III
5,054,684 A 10/1991 Farber et al.
5,064,085 A 11/1991 Ellenberg
5,065,908 A 11/1991 Mengeu
5,065,909 A 11/1991 Pino et al.
5,085,335 A 2/1992 Carbaugh
5,085,336 A 2/1992 Lynd
5,114,011 A 5/1992 Robbins, III ..... 215/388 X
5,114,074 A 5/1992 Frauenthal et al.
5,148,971 A 9/1992 Ahn
5,160,058 A 11/1992 Ahn ..... 215/388
5,167,354 A 12/1992 Cohanfard
5,172,827 A 12/1992 Chang et al.
5,188,283 A 2/1993 Gu ..... 215/388 X
5,242,079 A 9/1993 Stephens et al.
5,273,172 A 12/1993 Rossbach et al.
5,361,934 A 11/1994 Spence, Jr.
5,361,935 A 11/1994 Saguciо
5,417,369 A 5/1995 Lipson
5,462,194 A 10/1995 Barnwell
5,494,165 A 2/1996 Detrick ..... 215/229 X
6,116,446 A * 9/2000 Haughton et al. ..... 220/705

* cited by examiner

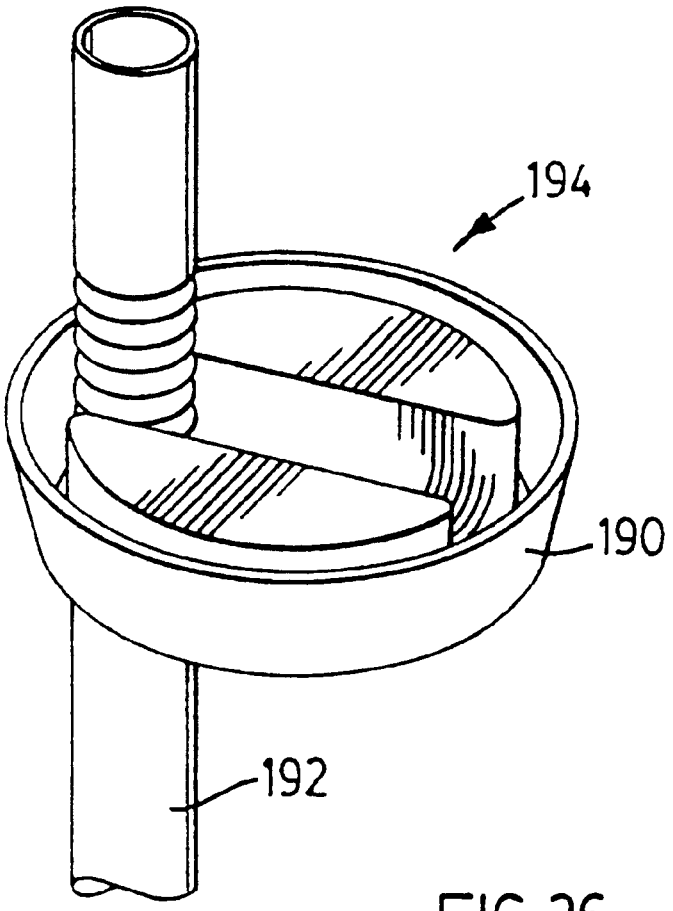
FIG.26
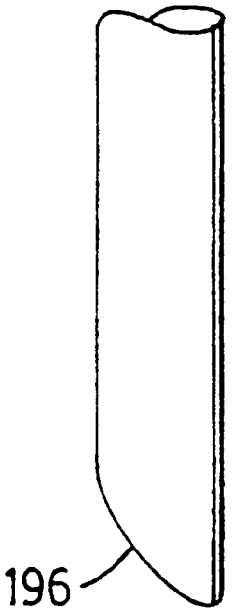

STOPPERS FOR INDIVIDUAL BEVERAGE CONTAINERS

CROSS REFERENCE TO RELATED PATENT APPLICATION

This patent application is a 371 of Pct/ca/99/00400 which is a continuation of U.S. Application Ser. No. 09/080,224 filed on May 18, 1998 entitled STOPPERS FOR INDIVIDUAL BOTTLE-TYPE BEVERAGE CONTAINER and now issued as U.S. Pat. No. 6,116,446 which is incorporated herein by reference.

FIELD OF THE INVENTION

This invention relates to stoppers for individual beverage containers and in particular to stoppers that position a straw in an individual beverage container.

BACKGROUND OF THE INVENTION

Individual beverage containers such as bottles and cartons have been popular for many years. They provide an easy storage and carrying container for a beverage. The individual bottle provides one serving for the user. Similarly, a carton with a side opening may provide one serving for the user. The serving would be comparable to a large glass of the beverage. Such containers are advantageous in a number of settings because they provide one serving of the beverage and a container therefore. Originally after use the bottle was thrown away. More recently these bottles are recyclable. Similarly many of the carton type containers may be recycled.

Most individual juice bottles sold in North America are wide-mouthed bottles, that is the mouth of the bottle is larger than one would typically find on a pop-type bottle. The disadvantage of the wide-mouthed bottles is that drinking may be somewhat problematic. Specifically, the wide mouth is generally too wide to put one's mouth around entirely and yet too narrow to allow one to drink from it in a manner used when drinking from a cup.

Carton type beverage containers with gable tops are well known. The top closure is formed by folding the top portion of the sides inwardly with a crease down the centre thereof and folding the top front and back portion inwardly until they meet and then gluing the front, back and sides together to form a top closure. These tops are traditionally opened by breaking the seal of one half of the top closure and folding outwardly the top portion of one of the sides to form a spout. Often it is difficult to break the seal thereby damaging the cardboard around the spout. Further once a gable top is opened in this manner it may be closed thereafter but not sealed. Accordingly more recently some beverage containers with a gable top are provided with a side pour spout that is positioned on one side of the gable top. The side pour spout is generally cylindrical and has a flange, resealable threaded neck and top. The gable type cartons have similar advantages as the individual bottle beverage containers but they also have the same disadvantages with regard to drinking straws.

In order to address this problem drinking straws are frequently available at the point of purchase. The use of a drinking straw reduces the chance of accidentally spilling the beverage while drinking. In addition young people seem to find drinking easier and more fun when using a straw.

Although straws are often made available at the point of purchase this is not typically the case when the beverage is sold at a vending machine. Further, retailers may run out of the straws before they run out of the beverage. In addition, where the consumer does not drink the beverage directly after purchasing it, the straw may be lost or damaged. Further, where the consumer does not drink the entire beverage at one time, if removed, the straw can become lost or can contaminate the consumer's other packages.

Some bottles which provide straws therein have been suggested. For example U.S. Pat. No. 2,748,968 issued to Attler on Jun. 5, 1956, U.S. Pat. No. 3,746,197 issued to Sather on Jul. 17, 1973 and U.S. Pat. No. 2,432,132 issued to Allen on Dec. 9, 1947 each shows a bottle with a straw therein. Each of these has a straw which extends above the mouth of the bottle and a cap which is modified to allow the straw to extend above the mouth of the bottle even when the cap is in position. The straw shown in the Allen patent extends out of the mouth of the bottle and then is wrapped around the neck of the bottle. In addition the Allen patent shows a small straw positioned adjacent to the straw and provides an air vent therefor.

Another prior art jar that has been suggested is U.S. Pat. No. 2,175,735 issued to Banks on Oct. 10, 1939. The Banks patent shows a jar which includes a dish which is positioned in the mouth of the jar and which holds such elements as a spoon, a fork or a straw. The dish has a laterally extending flange which rests on the mouth of the jar or an inner lip thereof. The dish is provided with an aperture and a collar or neck to hold the spoon, fork or straw. The dish is not securely positioned in the mouth of the jar rather it merely rests on the mouth of the jar. Further, the cap of the jar must be modified to accommodate the dish positioned in the mouth of the jar.

U.S. Pat. No. 2,052,307 issued to Kennedy on Aug. 25, 1936 shows another prior art beverage container and dispenser. The Kennedy patent shows a container which is preferably made from waterproof or waxed paper. The container includes a pair of long straws which extend through the cap of the container. A pair of telescoping small straws is positioned in the cap and each long straw extends through one of the small straws such that it can freely move up and down. Each long straw has a closure cap or small cork.

Another prior art beverage container is suggested in U.S. Pat. No. 3.291,331 issued to Grisham et al. on Dec. 13, 1966. The Grisham et al. patent shows a flexible straw holder. The straw holder is positioned in the neck of the beverage container. The straw holder includes a lower highly flexible portion having the straw positioned therein and an upper portion which snugly fits in the neck of the beverage container. The straw holder has a closed position wherein the upper end of the straw is below the mouth of the beverage container and an in use position wherein the upper end of the straw extends above the mouth of the beverage container. An object of this invention is that when the beverage container is opened the gas pressure will force the straw into the in use position.

U.S. Pat. No. 2,844,267 issued to Petriccione on Jul. 22, 1958 shows a combined drinking straw and bottle cap. The bottle cap includes a gasket with the straw positioned therein, a crown portion with a slot formed therein and liner. The cap is not removable and replaceable. Rather a portion of the liner is torn back to provide access to the straw.

Another prior art patent is shown in U.S. Pat. No. 3,568, 870 issued to Elston on Mar. 9, 1971. The Elston patent shows a plastic bottle with a cup positioned in the mouth thereof and crimped thereto. The cup is made of foil or other suitable material which would allow it to be crimped to the mouth of the bottle. The cup has an aperture formed therein for receiving a straw. The enlarged aperture allows the user to pour the contents of the bottle into a receptacle without removing the straw if the user so chooses.

Most of these prior art containers have a similar disadvantage and that is that they would be difficult to incorporate into the highly automated bottling process that is generally used today. For example many of the prior art jars discussed above would require the cap to be modified and this in turn might require the machine that attaches the cap to be modified as well. Some of the straw holders are not secured in the neck of the bottle and thus will not minimize spillage if the beverage container is knocked over. Alternatively some of the straw holders do not have the straw securely positioned therein and therefore allow liquid to seep out around the straw if the beverage container is knocked over.

Accordingly, it would be advantageous to provide a container with a straw already therein which is readily accessible and easy to use. Similarly it would be advantageous to provide a container with a stopper therein which minimizes the chance of spillage while drinking. Further, it would be advantageous to provide a stopper that would not interfere with the sealing mechanisms of existing jars and that could be easily incorporated into the automatic bottling process currently generally being used.

SUMMARY OF THE INVENTION

The present invention provides a stopper for use with an individual beverage container or the like. The stopper has a generally tubular side wall with an upper edge and a lower edge. The side wall is dimensioned to fit snugly in the neck of the beverage container with a pressure fit. A bottom extends inwardly from the side wall. A flat upper portion is integrally attached to the bottom and is spaced upwardly from the bottom. An aperture is formed in the bottom or the flat upper portion. In addition, a vent hole may be formed in the bottom or the flat upper portion. Preferably the flat upper portion is spaced from the side walls thereby forming a trough therebetween. Preferably the aperture is formed in the bottom and dimensioned to receive a straw snugly therethrough. Preferably the flat upper portion is divided into a first and a second upper portion with a channel therebetween, with the channel being contiguous with the aperture and dimensioned to receive an upper portion of the straw when in a stowed position.

In another aspect of the invention a stopper is provided for use with an individual beverage container and a straw. The stopper has a generally tubular side wall. The side wall has an upper edge and a lower edge and the side wall is dimensioned to fit snugly in the neck of the beverage container with a pressure fit. The upper edge of the stopper is generally in one plane. A bottom extends inwardly from the side wall. An aperture is formed in the bottom and is dimensioned to receive the straw snugly therein. A sleeve contiguous with the aperture extends downwardly therefrom and is dimensioned to receive the straw snugly therein. A vent hole may be formed in the bottom. The stopper may include a channel contiguous with the aperture for receiving the upper portion of the straw, wherein the channel is generally parallel to and spaced below the plane of the upper edge of the side wall.

In a further aspect of the invention a stopper is provided for use with an individual beverage container or the like. The stopper has a generally tubular side wall. The side wall has an upper edge and a lower edge and the side wall is dimensioned to fit snugly in the neck of the beverage container with a pressure fit. A bottom extends inwardly from the side wall. A flat upper portion is integrally attached to the bottom and spaced upwardly from the bottom. An aperture is formed between the side wall and the beverage container and a vent hole may be formed between the side wall and the beverage container.

The drinking straw would be provided inside the beverage container with a holder or stopper that supports the straw in the stowed and drinking positions; reduces the risk of accidental spills from the open container either when handling or drinking; and allows the straw to be restowed and the container recapped for intermittent use. An adhesive patch could be attached to the straw to draw the straw from the stowed to drinking position. A vent hole in the bottom of the holder would allow atmospheric pressure into the container while allowing beverage that may be present above the holder to drain back into the container. The straw, holder and patch would occur as a preassembled unit, ready for insertion into the beverage container at the time of container filling and capping. When inserted into the container, the assembly would be held in place in the container by means of a press fit between the holder and the interior of the neck of the container.

As a modification to the holder previously described, a server is suggested. The server would be provided inside the beverage container, held in place by means of a press fit.between the server and the interior of the neck of the container. The server would assist the drinking process by providing a directed and regulated flow of beverage from the container through a drinking opening when the beverage is consumed in the familiar manner by a consumer, serving a purpose analogous to a lid with a drinking opening and vent hole for a disposable coffee cup, where the beverage is made available at the drinking opening upon tipping the container toward the consumer's mouth, while providing a good measure of spill resistance from the open beverage container. At the same time, the drinking opening in the server would be of a size to accept a drinking straw that a consumer could provide, if available, allowing alternative consumption of the beverage through the drinking straw.

A feature of this invention is to provide a hygienic mechanism for bringing the drinking straw from the stowed position into the drinking position with the least amount of contact and effort by the consumer.

A further feature of this invention is to provide a mechanism that minimizes leakage should an upset open container occur, while also minimizing the leakage associated with handling and drinking from an open container.

A further feature of this invention is to provide a mechanism that allows the straw to be returned to the stowed position from the drinking position and vice versa several times, conveniently by the consumer.

A further feature of the invention is to provide a means for easily removing the drinking straw from the container if so desired by the consumer.

Yet a further feature of this invention is to provide such a device that is recyclable.

Further features of the invention will become apparent in the course of the following description.

BRIEF DESCRIPTION OF THE DRAWINGS

The invention will now be described by way of example only, with reference to the accompanying drawings, in which:

FIG. 26 is a perspective view of a stopper of the present invention showing a tenth alternate embodiment having a straw integrally attached thereto.

DETAILED DESCRIPTION OF THE INVENTION

Figure 1:
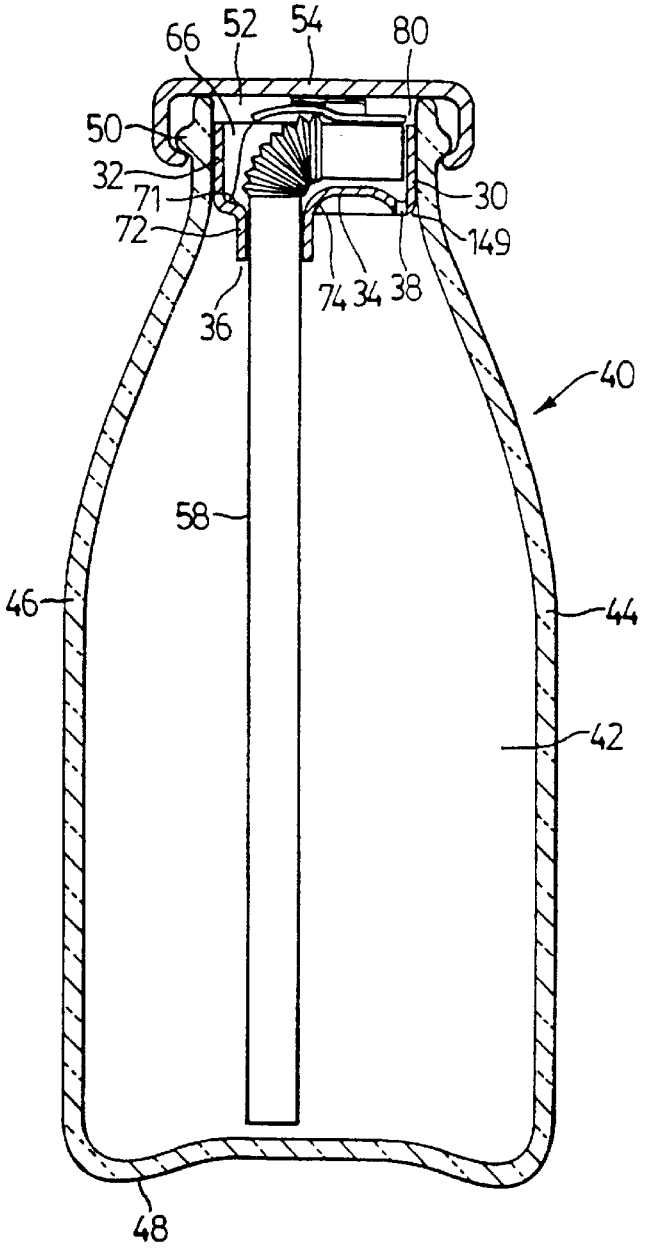
FIG. 1 is a cross sectional view of the stopper of the present invention positioned in a wide mouthed individual bottle with an expandable bendable straw positioned therein.
Figure 3:
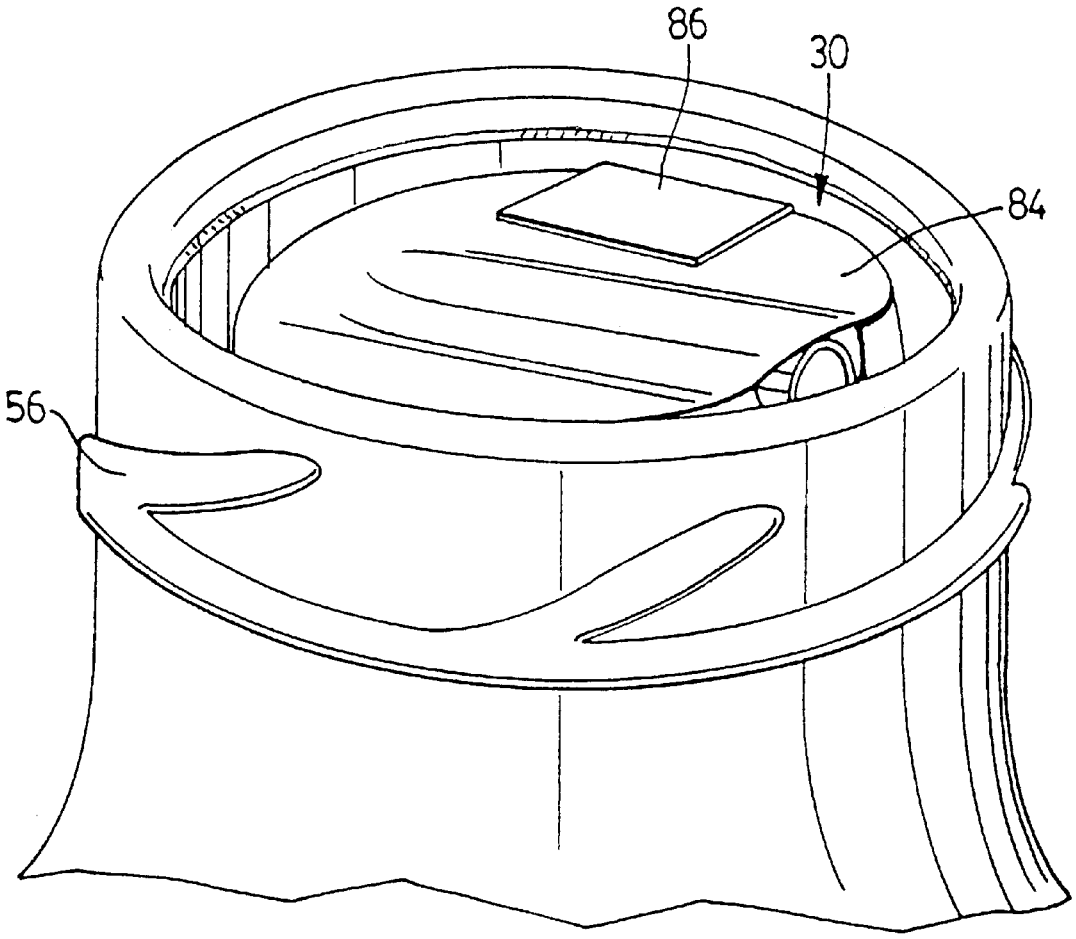
FIG. 3 is an enlarged perspective view of the stopper of the present invention positioned in a wide mouthed individual bottle with an expandable bendable straw positioned therein.
Figure 4:
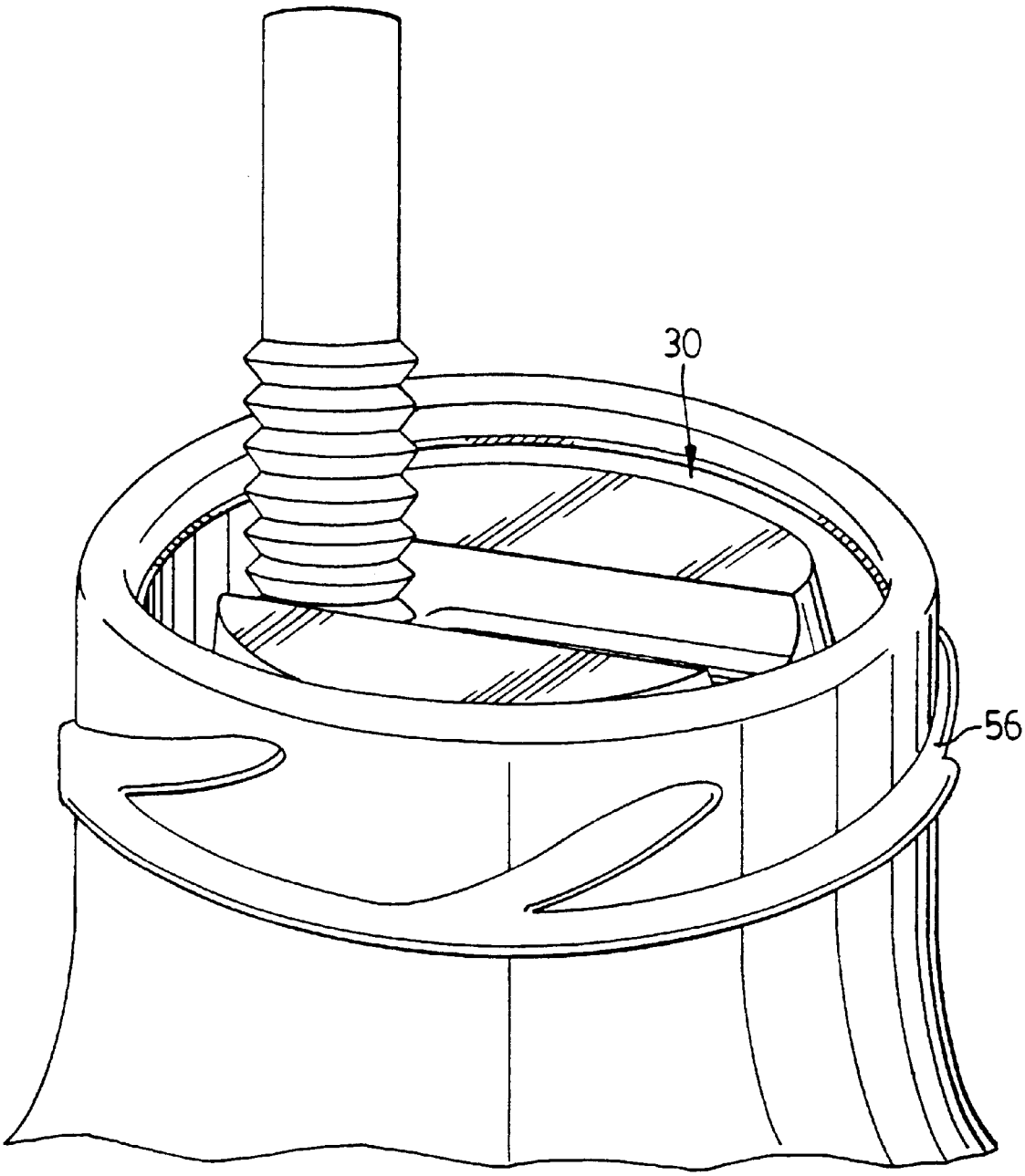
FIG. 4 is an enlarged perspective view of the stopper of FIG. 3 showing the straw in the upright or drinking position.

Referring to the drawings and in particular FIGS. 1, 3 and 4 a stopper of the present invention is shown generally at 30. The stopper 30 includes a generally tubular side wall 32, a bottom 34 with an aperture 36 and at least one vent hole 38 formed therein.

The stopper 30 is adapted to fit an individual beverage container or bottle 40 such as those commonly used for fruit juice and the like. Typically fruit juice bottles are wide mouth containers made from glass, plastic or other material. These bottles come in various shapes and sizes depending on the manufacturer and distributors. However, many of the different shaped bottles have necks that have the same interior dimensions and exterior dimensions. This is likely the case so that the different shaped bottles can fit into the same bottling machines. Accordingly although only one shape of bottle is shown in the drawings herein, it will be appreciated by those skilled in the art that this equally applies to all shapes of bottles. Further, it will be appreciated that a stopper of the present invention will fit into different shaped bottles that have the same throat and neck dimensions.

Figure 12:
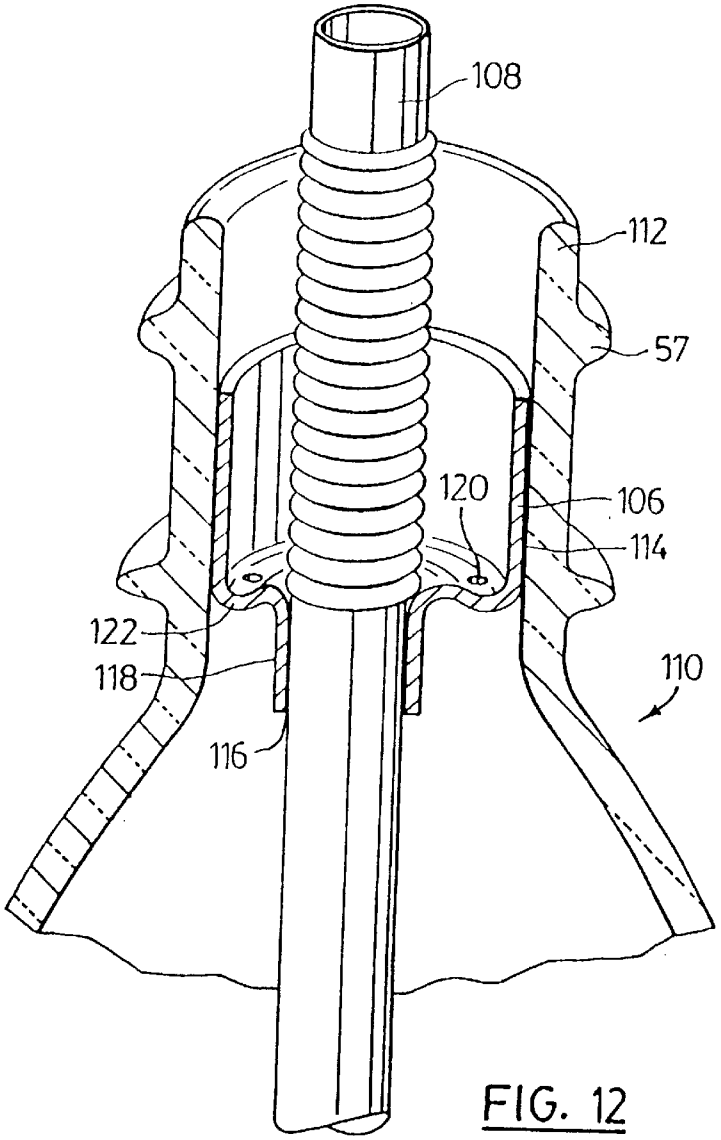
FIG. 12 is a partially broken away perspective view of the stopper of the present invention as shown in FIG. 11 with the straw in the drinking position.
Figure 11:
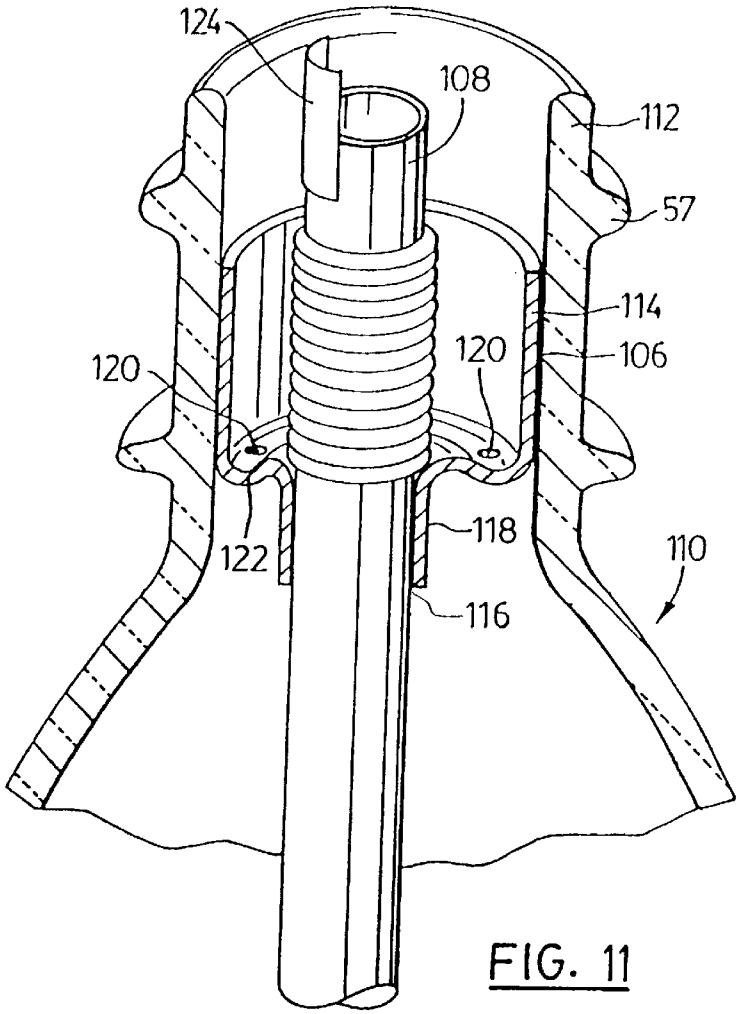
FIG. 11 is a partially broken away perspective view of a version of the stopper of the present invention positioned in a narrow mouthed individual bottle and having an expandable bendable straw positioned therein and shown in the closed or retracted position.

Bottle 40 has an interior volume 42 which is defined by the exterior walls 44. The exterior walls 44 include side walls 46, a bottom 48, a neck 50 and a mouth 52. Typically the inner diameter of the neck 50 is either conical or decreases slightly downwardly from the mouth 52 in a frustoconical shape and then increases to the diameter of the side walls 46. A cap 54 (shown in FIG. 1) of metal, plastic or other material is attachable to the neck 50 to seal bottle 40 and to cover the mouth 52. Typically the cap 54 is attachable to the bottle by a threaded type closure or a pressure type closure. A threaded type closure 56 is shown in FIGS. 3 and 4. Similarly, a threaded type closure is shown in FIGS. 11 & 12 wherein the neck is provided with threads 57 over which a cap may be attached. Alternatively a rim (not shown) is provided over which a cap may be attached through a pressure fit.

Figure 2:
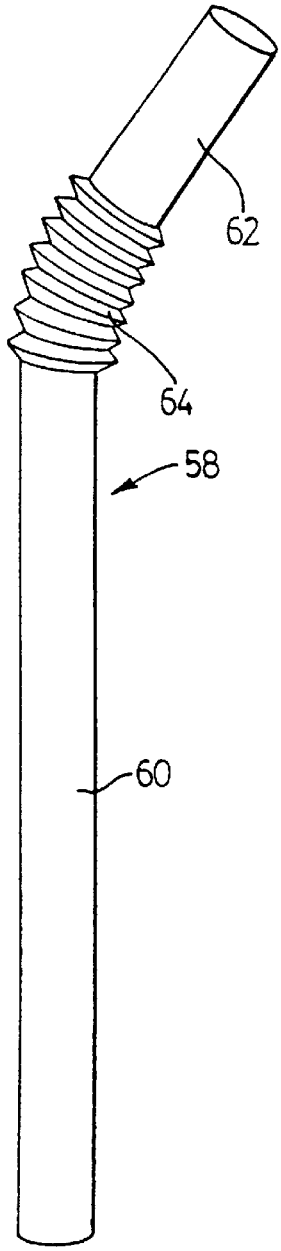
FIG. 2 is a perspective view of the bendable straw of FIG. 1.

A straw 58 may be used in conjunction with the stopper of the present invention. Referring to FIG. 2, preferably the straw 58 includes an elongate portion 60, short portion 62 and a corrugate portion 64 therebetween. The corrugate portion 64 allows for extension and compression of the straw 58. In addition it allows for flexible manipulation of the straw and in particular of short portion 62. Short portion 62 is dimensioned such that the straw can have a closed or stowed position as best seen in FIGS. 1 and 3. Elongate portion 60 of the straw 58 is dimensioned such that it reaches to the bottom of the bottle 40, as shown in FIG. 1.

Generally tubular side wall 32 of the stopper 30 is adapted to be positioned in the neck 50 of bottle 40 and to fit snugly therein. Side wall 32 may have a number of different configurations to ensure that it fits snugly therein, some examples of which will be described below. It is important that stopper 30 has enough structural integrity so that once it is positioned in the neck 50 of bottle 40 it is not easily removed.

Referring to FIGS. 1, 5, 6 and 7 stopper 30 has a generally tubular side wall 32 which has a slight inward angle so as to facilitate the positioning of stopper 30 in the neck 50 of bottle 40. The stopper shown in FIGS. 1, 5, 6 and 7 is made of thin material and in order to provide the stopper with enough rigidity a pair of ribs or webs 65 are formed therein. Each rib 65 is shaped such that a peripheral edge 67 is spaced inwardly from the side wall 32 and a peripheral trough 66 is formed therebetween. Each rib 65 has an inner wall 68 that is spaced from the inner wall of the adjacent rib such that a channel 70 is formed therebetween. Preferably, channel 70 has a curved shape such that when the corrugate portion 64 and the short portion 62 of the straw 58 are positioned in the stopper 30 and they are in the closed position they fit freely therein as shown in FIGS. 1 and 3. The bottom of trough 66 forms a circular inside surface 71. During the assembly process a cylindrical pressing tool may be used which bears on cylindrical inside surface 71.

Figure 5:
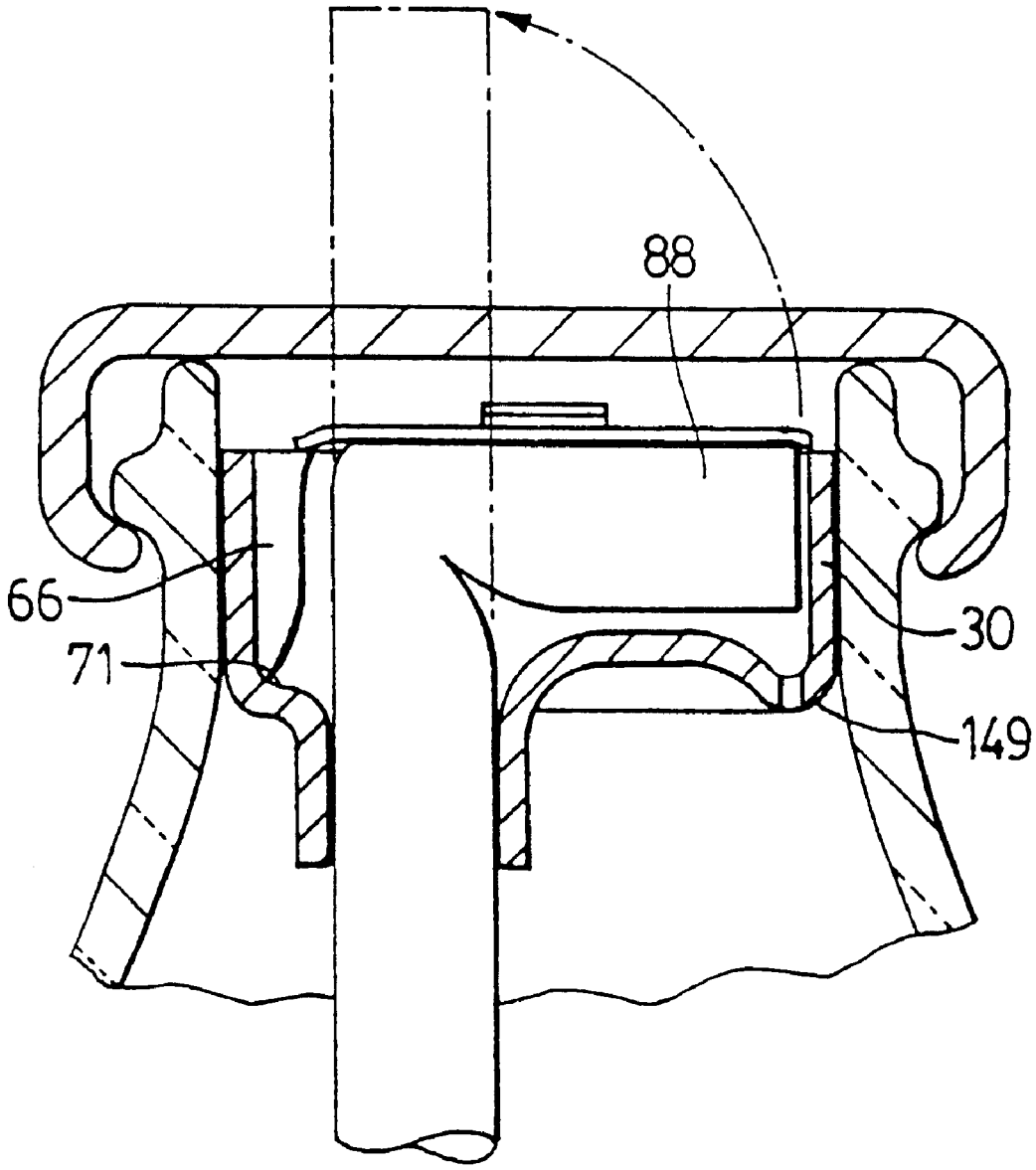
FIG. 5 is a cross sectional view of the stopper of the present invention positioned in a wide mouthed individual bottle and having a straw bent into the closed position and having the drinking position shown in phantom.

Referring to FIGS. 1 and 5, stopper 30 is designed to withstand some compression forces that will be applied during the assembly process. A fold 149 is formed between bottom 34 and side wall 32 to isolate bottom 34 from side wall 32. The fold 149 is an extension of trough 66. Therefore when radial compression force is applied to the side walls 32 the fold 149 will absorb the force by deforming or by the side walls sloping inwardly and thereby the bottom 34 is less likely to buckle. If no fold 149 was formed between bottom 34 and side wall 32, a radial compression force of sufficient strength would cause the bottom 34 to buckle.

Figure 6:
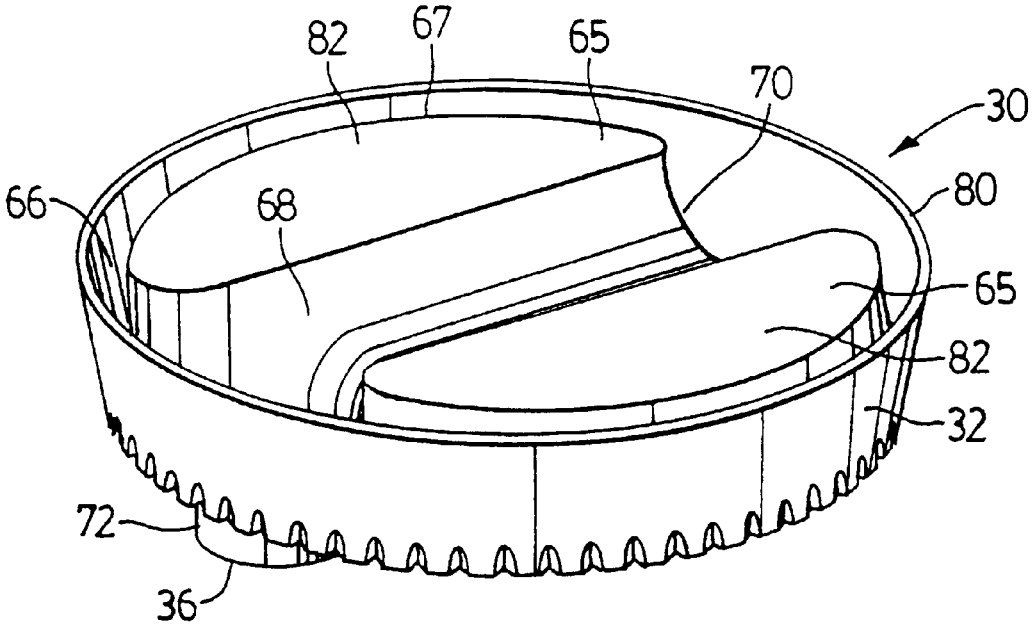
FIG. 6 is an enlarged perspective view of the stopper of the present invention and having an alternate side wall configuration.

Referring to FIGS. 1 and 6, aperture 36 of stopper 30, in this embodiment, is adapted to receive a straw 58 (not shown in FIG. 6). A sleeve 72 extends upwardly from the drinking aperture 36 and downwardly from channel 70 and is positioned proximate to the side wall 32. Preferably sleeve 72 is as close to the side wall as practicable so that when the straw 58 is positioned therein the short portion 62 thereof is as long as possible. Sleeve 72 is adapted to receive straw 58. Sleeve 72 provides support to straw 58 once placed in aperture 36. Aperture 36 in stopper 30 may be a circular hole, an "X" or the like whereby straw 58 may be easily inserted therethrough. Sleeve 72 is adapted to hold straw 58 in position during repeated manipulation of straw 58 from the in use to stowed position.

Figure 8:
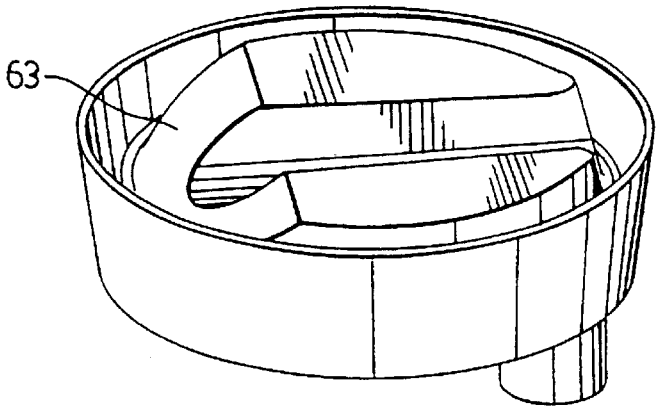
FIG. 8 is an enlarged perspective view of a second alternate embodiment of the stopper of the present invention showing an alternate channel for a straw.

Channel 70 is configured such that it is generally a "U" shape between ribs 65. Ribs 65 add rigidity to stopper 30. Radius 74, best seen in FIG. 1, between the sleeve 72 and the channel 70 in the stopper 30 reflects the shape of the corrugate portion 64 of the straw 58 when in the bent position. Ribs 65, on the side opposite aperture 36, may have a portion bent away from each other, as shown at 61 in FIG. 9, or be sloped toward the bottom 34, as shown at 63 in FIG. 8, to provide easy access to the top of short portion 62 of the straw 58. Thereby the user may easily move the straw 58 from the stowed to the drinking position.

Vent hole 38 is provided in stopper 30 to allow, upon removal of cap 54, air to pass through the stopper 30 and equalize the pressure above and below the stopper 30 positioned in bottle 40. This is particularly important with carbonated beverages wherein on opening the cap carbon dioxide gas will escape from the interior volume 42 of the container 40 through vent hole 38 rather than through the straw 58. The vent hole 38 should be of size and number sufficient to allow the beverage to drain or flow into the interior volume 42 of the container 40 should beverage be present above the stopper 30. Alternatively, if the fit between the stopper 30 and straw 58 is loose enough to allow some liquid therebetween but tight enough to hold the straw 58 in position, vent hole 38 can be eliminated.

Figure 7:
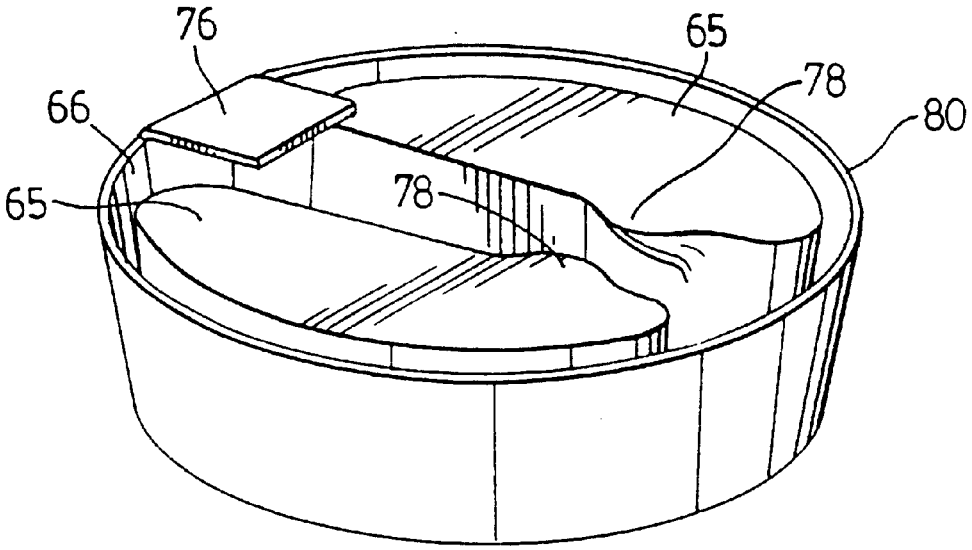
FIG. 7 is an enlarged perspective view of an alternate embodiment of the stopper of the present invention having detents to hold a straw in the closed position.

Referring to FIG. 7, a remove tab 76 may be formed into the side wall 32 of the stopper 30 and folded down so that it will not interfere with the cap 54 being positioned on the bottle 40. Remove tab 76 provides a mechanism to allow easy removal of the stopper 3.0 and straw 58 from bottle 40, if desired by the consumer.

Stow tabs 78, shown in FIG. 7, may be formed in the ribs 65 of the stopper 30 for the purpose of keeping the straw 58 in the stowed position. Stow tabs 78 are resiliently deformable such that upon manipulation of the straw 58, the straw may be moved from the stowed position to the in use position and vice versa.

The upper edge 80 of the side wall 32 of the stopper 30 should not be of a shape so as to interfere with the seating capacity of cap 54.

Figure 9:
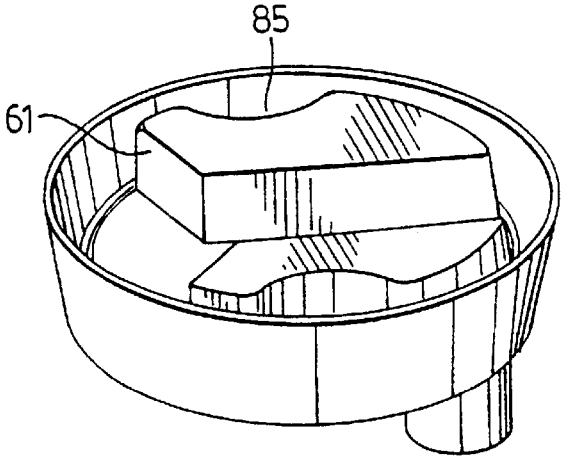
FIG. 9 is an enlarged perspective view of a third alternate embodiment of the stopper of the present invention showing an alternate channel for a straw.

Each rib 65 has a flat portion 82 that will accept a removable tag or patch 84 with adhesive on the side thereof, as shown in FIG. 3 Tag 84 is removably attached to the flat portions 82 of ribs 65. Tag 84 may also be attached to the top of short portion 62 of straw 58 in the stowed position. Tag 84 has a pull tab 86. Thus when the user pulls tab 86 tag 84 will disengage from ribs 65 and pull straw 58 from the stowed position to the in use position. Alternatively, as shown in FIG. 9, rather than providing pull tab 86 the ribs 65 may be provided with indentations or dimples 85 to provide a place where a user may grip tag 84 and remove it from the ribs 65. It will be appreciated by those skilled in the art that tag 84 may have printed matter thereon thus providing a number of opportunities in the marketing of the product. Advertising or other contest type information could be printed on both sides of tag 84. The adhesive used on tag 84 may be of the type that allows removal and replacing. Thus tag 84 could be used in a variety of promotional campaigns, for example the consumer has to collect a number of tags to spell a word. Tag 84 will also keep straw 58 in the stowed position during the automated assembly process when the stopper/straw/tag combination is positioned in bottle 40.

Referring to FIG. 5, alternatively the stopper 30 of the present invention could be used in conjunction with a generally available straight straw 88. Straight straw 88 is made of a material that allows it to be kinked into a roughly right angle configuration and kept in that position without permanent deformation to its cylindrical nature.

Figure 10:
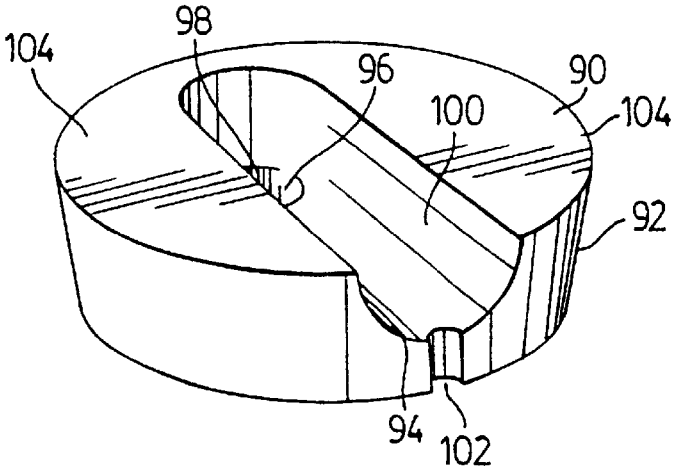
FIG. 10 is an enlarged perspective view of a fourth alternate embodiment of the present invention showing an alternate channel for a straw.

Alternatively, as illustrated in FIG. 10, a stopper 90 may be made of a thick wall-type material such as plastic foam or the like. Stopper 90 functions similarly to stopper 30 and has similar features. Stopper 90 has side walls 92 and a bottom 94 that has an aperture 96 formed therein for receiving a straw. A sleeve 98 extends downwardly from aperture 96 and is formed by the thick wall material. A channel 100 is contiguous with aperture 96 and provides a place for an upper portion of a straw. A vent hole 102 is formed in bottom 94. Flat portions 104 are formed of the thick wall material.

FIGS. 11 and 12 show a stopper 106 for a drinking straw 108, similar to drinking straw 58, that is adapted for use in a regular mouth "pop" bottle 110 with neck 112. Stopper 106 is similar to stopper 30 described above. Stopper 106 includes a generally tubular side wall 114, an aperture 116, a sleeve 118, vent holes 120 and a bottom 122. A removable pull tag 124 is attached to the upper portion of straw 108 to pull the straw from the stowed compressed position to the in use position.

Figure 13:
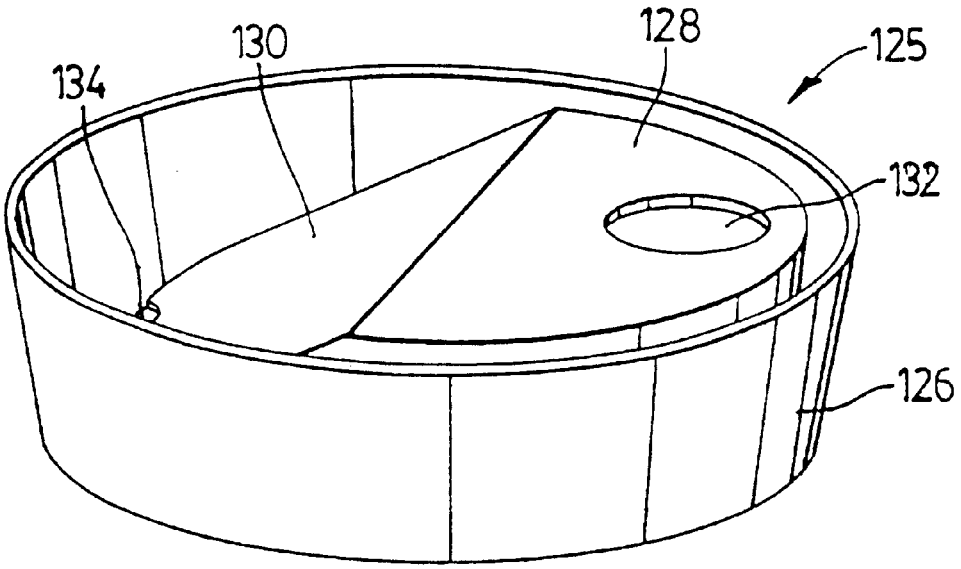
FIG. 13 is an enlarged perspective view of a fifth alternate embodiment of the present invention showing a stopper adapted to facilitate drinking from a bottle without spilling.
Figure 14:
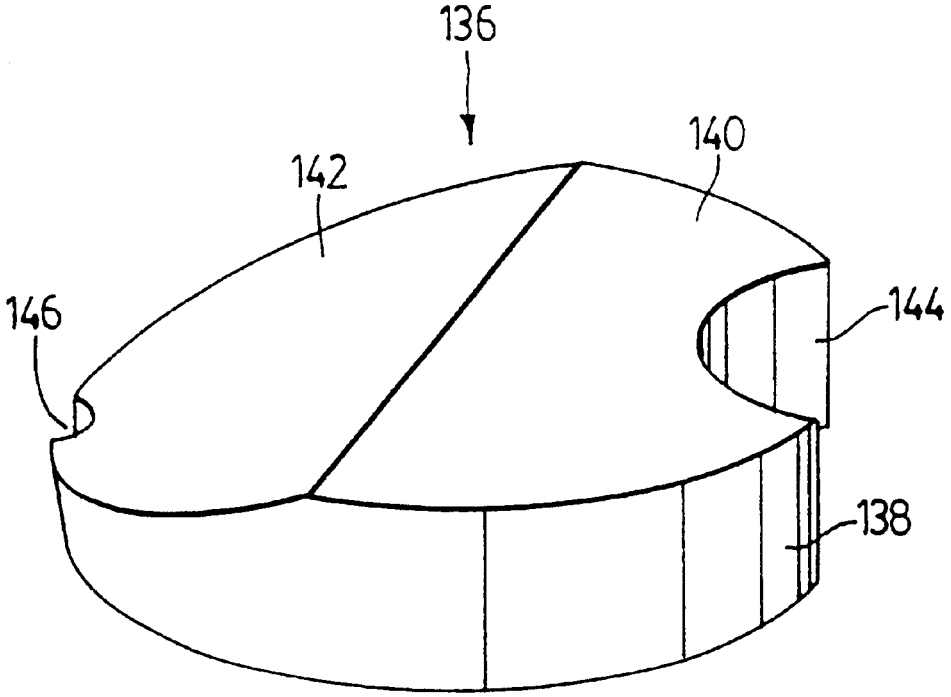
FIG. 14 is an enlarged perspective view of a sixth alternate embodiment of the present invention showing a stopper adapted to facilitate drinking from a bottle without spilling.

FIGS. 13 and 14 show stoppers of the present invention which are adapted to facilitate drinking directly from the bottle so that the user need not put the entire mouth of the bottle into their mouth before drinking. FIG. 13 shows a thin walled stopper 125 which includes a generally tubular side wall 126, a raised flat portion 128, and a sloped portion 130. An aperture 132 is formed in raised flat portion 128 which is large enough to allow a user to drink therethrough. A vent hole 134 is formed at the lower end of the sloped portion 130. The vent hole 134 allows air to enter the bottle 40 as beverage is allowed to exit the aperture 132 while also providing a means for beverage that may be present in the stopper to drain back into the bottle. The side wall 126 of the stopper 125 would serve the same purpose as the side wall 32 of the stopper 30.

Similarly, FIG. 14 shows a thick walled stopper 136 made from plastic foam or the like. Stopper 136 is similar to stopper 125 but made from different material. Stopper 136 has a side wall 138, a flat portion 140 and a sloped portion 142. A semi-circular aperture 144 is formed in side wall 138 to provide a drinking opening when stopper 136 is positioned in a bottle. A small aperture 146 is formed in the side wall 138 adjacent to the lower end of the sloped portion 142 to provide a vent hole when stopper 136 is positioned in a bottle.

Stoppers 125 and 136 are adapted for drinking through aperture 132 and portion 144. These are dimensioned and shaped to allow for a satisfactory flow of beverage to the user and, alternatively, be able to accept through the drinking opening a straw or straws provided by the user, thereby allowing consumption of the beverage through drinking straws with the stopper still in place in the interior of the neck of the container.

Figure 16:
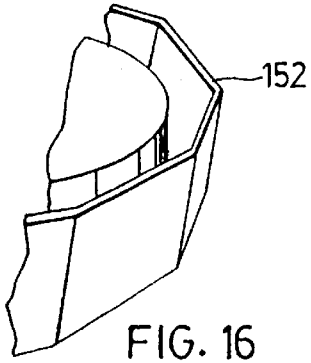
FIG. 16 is is a partial perspective view of a stopper of the present invention showing a second alternate embodiment having a polygon shaped side wall.
Figure 15:
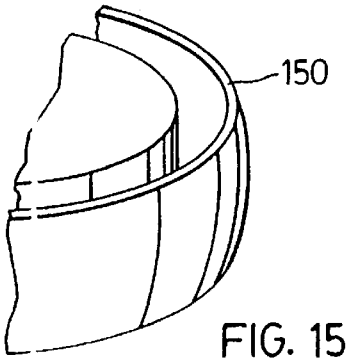
FIG. 15 is a partial perspective view of a stopper of the present invention showing an alternate embodiment having a barrel shaped side wall.
Figure 17:
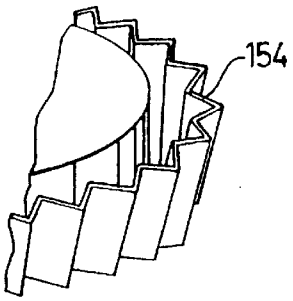
FIG. 17 is a partial perspective view of a stopper of the present invention showing a third alternate embodiment having a saw tooth shaped side wall.
Figure 18:
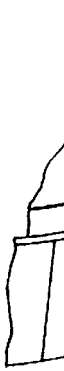
FIG. 18 is a partial perspective view of a stopper of the present invention showing a fourth alternate embodiment having a segmented side wall.
Figure 20:
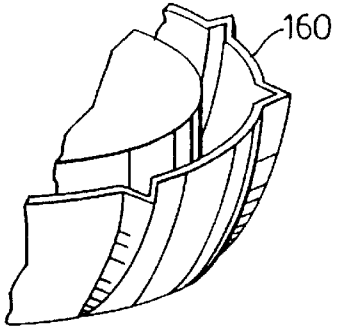
FIG. 20 is a partial perspective view of a stopper of the present invention showing a sixth alternate embodiment having an outwardly ridged sloped side wall.
Figure 21:
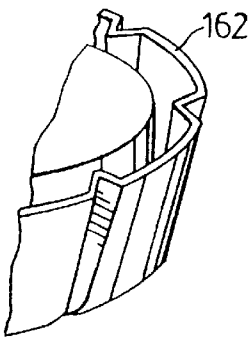
FIG. 21 is a partial perspective view of a stopper of the present invention showing a seventh alternate embodiment having an inwardly ridged sloped side wall.
Figure 22:
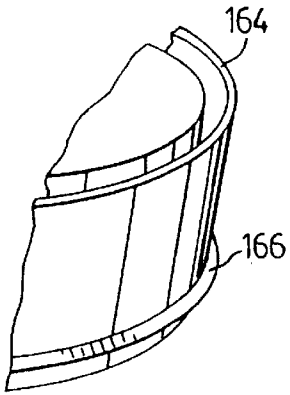
FIG. 22 is a partial perspective view of a stopper of the present invention showing an eighth alternate embodiment having a generally straight side wall with an annular ring.
Figure 19:
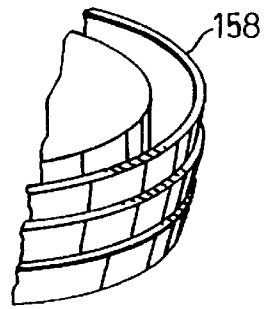
FIG. 19 is a partial perspective view of a stopper of the present invention showing a fifth alternate embodiment having a ringed or stepped side wall.
Figure 23:
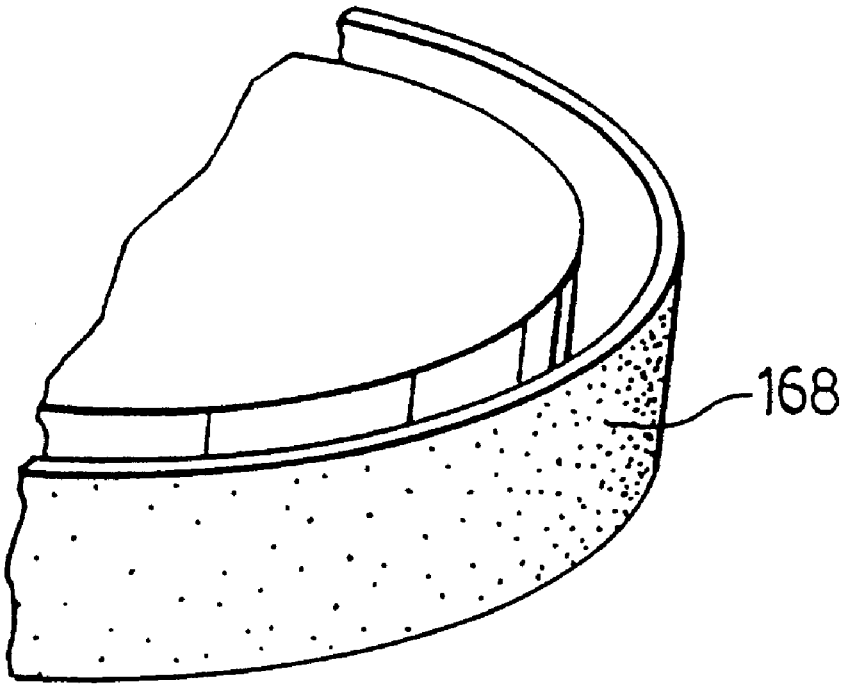
FIG. 23 is a partial perspective view of a stopper of the present invention showing a ninth alternate embodiment having a textured side wall.

The stopper of the present invention may have a number of different side wall configurations. Many such configurations are shown in FIGS. 15 to 23. Each configuration is such that the stopper may be positioned in bottle 40 with a friction or press fit. Each side wall configuration incorporates some flexibility such that the stopper can be positioned in necks within a predetermined tolerance range. FIG. 15 shows a barrel shaped side wall 150. FIG. 16 shows a polygon shaped side wall 152. FIG. 17 shows a saw tooth shaped side wall 154. FIG. 18 shows a segmented side wall 156. FIG. 19 shows a stepped side wall 158. FIG. 20 shows an outwardly ridged sloped side wall 160. FIG. 21 shows an inwardly ridged sloped side wall 162. FIG. 22 shows a side wall that is a generally straight side wall 164 with an annular ring or wiper edge 166 formed therein. The annular ring 166 may be positioned at the lower edge of the side wall, to squeegee beverage from the interior of the neck 50 of a container 40 during automated assembly of the stopper/straw/tag assembly into bottle 40. FIG. 23 shows a side wall having a textured surface 168. The textured surface 168 would allow the stopper to grip the neck of the bottle even if during the bottling process the inside surface of the bottle is "wet" since the textured surface would provide a path for the liquid to flow into the interior volume Referring to FIG. 26, as a further alternative the stopper 190 and straw 192 could be integrally attached as shown generally at 194. Similar to the above stoppers the unitary stopper/holder 194 would have a press fit and thus would have the features of one of the stoppers described above. Further, as described above the straw 192 can be manufactured with or without corrugations as chosen by the manufacturer. The straw 192 would be flexible such that if on installation the straw would touch the bottom of the bottle the straw would flex so that the stopper/holder 194 could still fit tightly into the bottle.

Straw 192 has a bevelled end 196 to minimize the chance of the user sucking on the straw such that it sticks to the bottom of the bottle and no liquid can enter therein.

Preferably the stopper 30 of the present invention is manufactured by way of injection molding. There are a number of features of stopper 30 that make it adaptable to an injection molding process. Particularly stopper 30 has a uniform wall thickness and a thin wall design. In addition, as discussed above, the side wall 32 and alternate side walls shown in the drawings are angled slightly inwardly from the upper edge to the lower edge. The angled side walls allow the stopper to easily be released from the mold in the injection molding process. The uniform wall thickness makes it easier to mold in the injection molding process. The thin wall design keeps the cost of material as low as possible. In addition the thin wall design keeps the cost of manufacturing low since it only requires a short cycle time.

Figure 24:
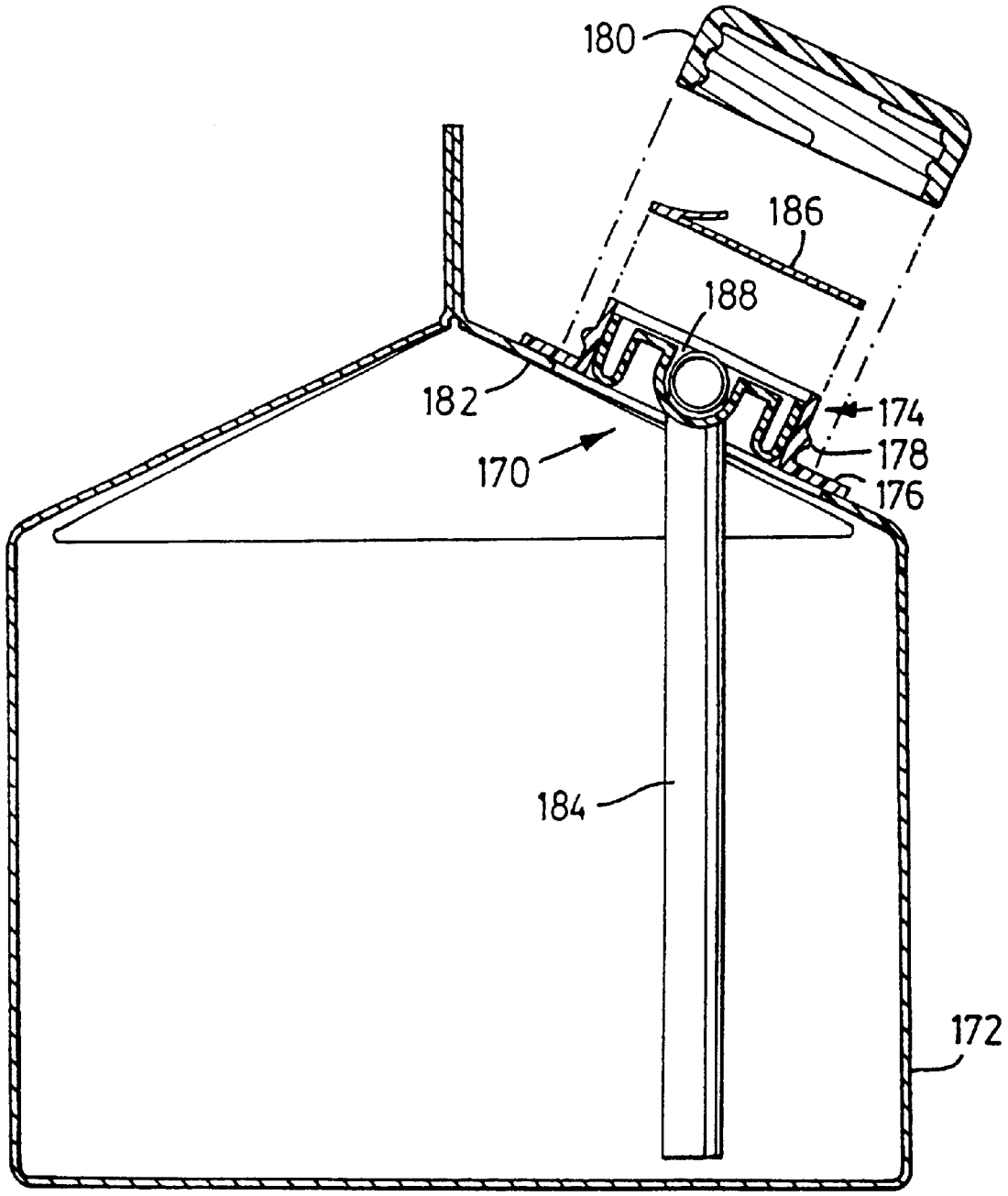
FIG. 24 is a cross sectional view of a stopper of the present invention shown in a side spout of a gable type carton beverage container with an expandable bendable straw positioned therein.
Figure 25:
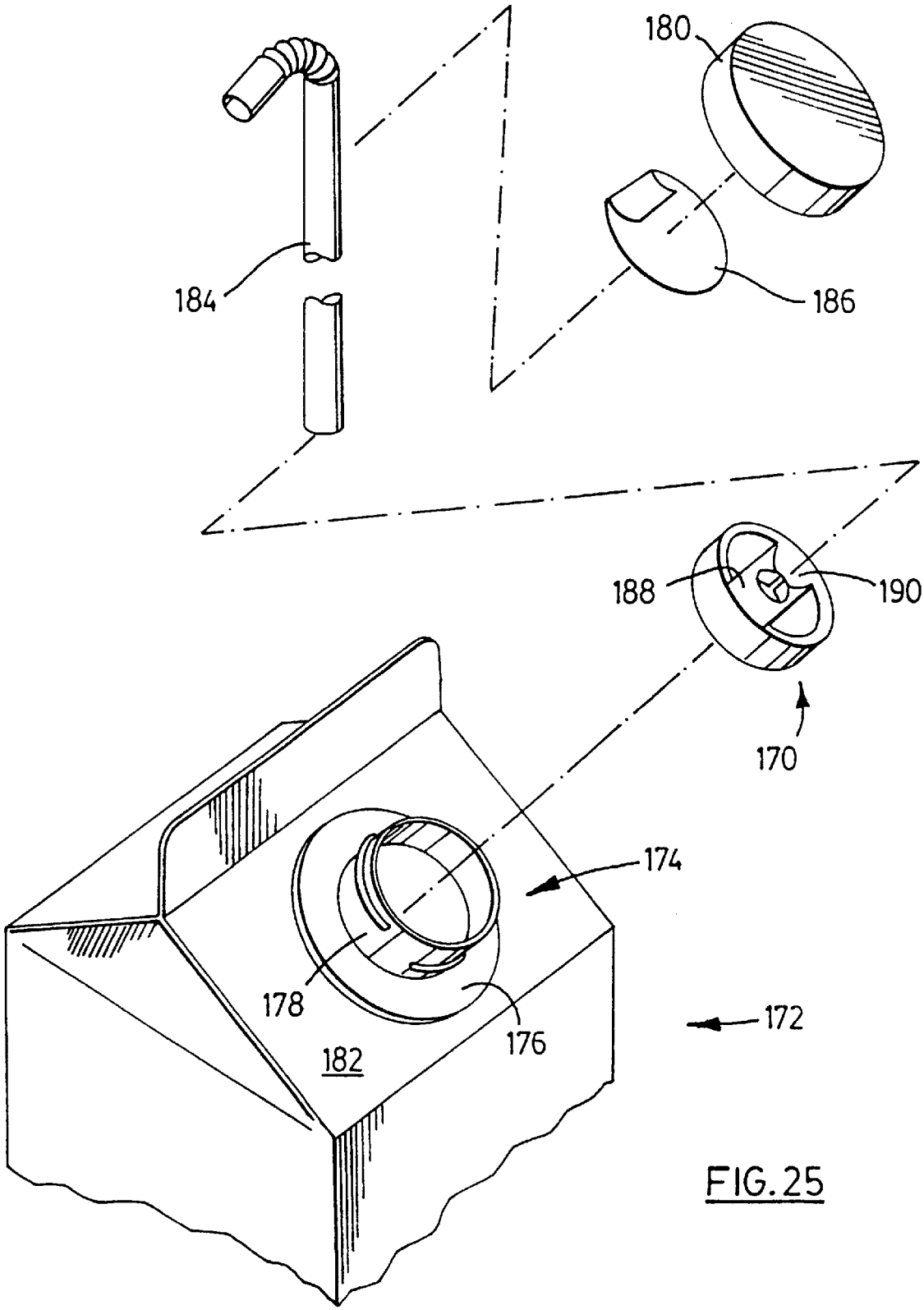
FIG. 25 is an enlarged blown apart broken away perspective view of the stopper/straw/carton assembly of FIG. 24.

An alternate use for the stopper of the present invention is shown in FIGS. 24 and 25 wherein a stopper 170 is positioned in a gable top carton 172. Stopper 170 includes most of the features described above with regard to stopper 30. Further the different side wall configurations described above would be equally applicable to stopper 170. Stopper 170 is positioned in a side pour spout or neck 174. A straw 184 is positioned in stopper 170. A tag or patch 186 is used to hold straw 184 in place and to seal the neck 174.

The side pour spout or neck 174 is generally cylindrical and has a flange 176, a threaded neck 178 and top 180. Flange 176 is attached to a sloped gable portion 182 of carton 172. As can be seen in the FIGS. 24 and 25, stopper 170 is not coaxially aligned in carton 172 and therefore straw 184 positioned therein is not coaxially aligned. To allow the user to easily move the straw around the bottom of the carton sleeve 72 of stopper 30 is eliminated or modified.

Referring to FIG. 25, the stopper 170 is positioned in neck 174. Straw 184 is positioned in stopper 170. Patch 186 is attached to stopper 170 or neck 174. Assembly of the stopper 170, straw 184 and patch 186 in the neck 174 could occur either before or after the neck 174 is attached to the carton 172. Stopper 170 could be positioned in any rotational attitude, either with the trough 188 being horizontal, as in FIGS. 24 and 25 or sloped, with the straw hole 190 either proximate to the upper or lower edge of the neck 174. The tag or patch 186 would attach to the rim of the neck 174 so as to provide a seal. Typically gable top cartons with necks currently have a similar type seal.

It will be appreciated that the above description related to one embodiment by way of example only. Many variations on the invention will be obvious to those skilled in the art and such obvious variations are within the scope of the invention as described herein whether or not expressly described.

What is claimed as the invention is:

1. A stopper for use with an individual beverage container having a neck comprising a generally tubular side wall (32) having an upper edge and a lower edge and the side wall being dimensioned to fit snugly in the neck (50) of the beverage container with a pressure fit and a bottom (34) extending inwardly from the side wall (32) characterized by:

a flat upper portion (82) integrally attached to the bottom (34) and spaced upwardly from the bottom (34), the flat upper portion being spaced from the generally tubular side wall thereby forming a trough therebetween; and an aperture (36) formed in the bottom (34) and dimensioned to receive a straw (58) snugly therethrough, the flat upper portion being divided into a first and a second upper portion (65) with a channel (70) therebetween, the channel (70) being contiguous with the aperture (36) and dimensioned to receive an upper portion (62, 88) of the straw (58) when in a stowed position.

2. A stopper as claimed in claim 1 further including a vent hole (38) formed in one of the bottom (34) and the flat upper portion (82).

3. A stopper as claimed in claim 1 wherein the channel (70) has tabs (78) formed therein for retaining the straw (58) in the stowed position.

4. A stopper as claimed in claim 1 further including a tag (84) releasably attached to the flat upper portion (82).

5. A stopper as claimed in claim 1 wherein the side wall has a barrel shape (150).

6. A stopper as claimed in claim 1 wherein the top view of the side wall has a polygon shape (152).

7. A stopper as claimed in claim 1 wherein the side wall has a saw tooth shape (154).

8. A stopper as claimed in claim 1 wherein the side wall is segmented (156).

9. A stopper as claimed in claim 1 wherein the side wall has a stepped shape (158).

10. A stopper as claimed in claim 1 wherein the side wall has an outwardly ridged shape (160).

11. A stopper as claimed in claim 1 wherein the side wall has an inwardly ridged shape (162).

12. A stopper as claimed in claim 1 wherein the side wall has an annular ring (166) extending outwardly therefrom.

13. A stopper as claimed in claim 1 wherein the side wall has a textured outer surface (168).

14. A stopper as claimed in claim 1 wherein each of the side wall (32), the bottom (34), the first and second upper portion (65), the trough (66) and the channel (70) all have thin walls.

15. A stopper as claimed in claim 14 wherein each of the side wall (32), the bottom (34) the first and second upper portion (65), the trough (66) and the channel (70) all have generally the same wall thickness.

16. A stopper as claimed in claim 1 wherein the side wall (32) is angled slightly inwardly from the upper edge to the lower edge.

17. A stopper as claimed in claim 1 wherein the trough (66) has a bottom Inside cylindrical surface.

18. A stopper as claimed in claim 1 further including a sleeve (72) contiguous with the aperture (36) and extending downwardly therefrom dimensioned to receive a straw (58) snugly therein.

19. A Stopper as claimed in claim 1 further including a straw (58) inserted into the aperture (36) and fitting snugly therein.

20. A stopper as claimed in claim 1 further including a straw extending through the aperture (36) and integrally attached to the stopper.

21. A stopper as claimed in claim 1 wherein the straw (58) has a beveled lower end (196).

22. A stopper as claimed in claim 1 wherein the individual beverage container is a gable type carton (172) with a side pour spout.

23. A stopper as claimed in claim 1 wherein the individual beverage container is a wide mouthed individual bottle.

24. A stopper as claimed in claim 1 wherein the individual beverage container is a narrow mouthed long neck individual beverage container.

* * * * *